US007029360B1

(12) United States Patent
Hawkins

(10) Patent No.: US 7,029,360 B1
(45) Date of Patent: Apr. 18, 2006

(54) BOBBLE HEAD FLUID CONTAINER

(76) Inventor: Victor Jonathan Hawkins, 2462 Wine Country Ave., Napa, CA (US) 94558

( * ) Notice: Subject to any disclaimer, the term of this patent is extended or adjusted under 35 U.S.C. 154(b) by 343 days.

(21) Appl. No.: 10/702,789

(22) Filed: Nov. 5, 2003

(51) Int. Cl.
*A63H 3/00* (2006.01)
*B65D 41/00* (2006.01)
*B65D 83/00* (2006.01)

(52) U.S. Cl. ..... 446/74; 206/457; 215/229; 215/388; 446/391

(58) Field of Classification Search ..... 206/457; 215/11.1, 11.6, 229, 388; 446/74, 384, 391
See application file for complete search history.

(56) References Cited

U.S. PATENT DOCUMENTS 1,660,085 A * 2/1928 Elnain ..... 222/78
2,546,122 A * 3/1951 Goldfarb ..... 446/72
2,731,751 A * 1/1956 Green ..... 446/28
4,816,000 A * 3/1989 Hsu ..... 446/74
4,971,211 A * 11/1990 Lake ..... 215/6
5,071,387 A * 12/1991 Pottick ..... 446/475
5,201,460 A * 4/1993 Caines ..... 229/103.1
5,312,282 A * 5/1994 Cooper ..... 446/27
5,361,987 A * 11/1994 Matheussen et al. ..... 239/33
5,540,611 A * 7/1996 Lapoint et al. ..... 446/72
5,636,740 A * 6/1997 Finkiewicz et al. ..... 206/457
5,738,232 A * 4/1998 Roberts et al. ..... 215/228
6,511,359 B1 * 1/2003 Lui ..... 446/321

* cited by examiner

*Primary Examiner*—John A. Ricci
(74) *Attorney, Agent, or Firm*—Risto A. Rinne, Jr.

(57) ABSTRACT

An apparatus for containing a fluid for human consumption includes a container. A spring is attached to a screw on type of lid disposed at the top of the container. A support member of a bobble head engages a top of the spring. A hole is provided in the container that is adapted to receive a straw. The support member is attached to a head. The spring supports the head above the lid so it can bobble from side to side, twist around a center axis, or bob up and down. The head is urged downward and protrusions and recesses in the support member and lid act like gear teeth to engage with each other and permit rotating the head and lid simultaneously to either loosen or tighten the lid. A modified threaded container having a lower and upper half is also described.

17 Claims, 3 Drawing Sheets

BOBBLE HEAD FLUID CONTAINER

BACKGROUND OF THE INVENTION

1. Field of the Invention

The present invention, in general, relates to fluid containers and, more particularly, to a fluid container for use with a straw that includes a bobble head.

A bobble head is a well known type of device that supports a simulated head atop a lower member (i.e., the rest of a body) to create a figurine, either human or otherwise. The typical bobble head includes a spring that is disposed intermediate the head and the lower member. The spring is attached at a lower end thereof to an upper part of the body and at an upper end thereof to the simulated head.

The spring suspends the simulated head above the body and allows the head to shake slightly up or down, tilt from side to side, forward and back, and even to rotate slightly about a center longitudinal axis (i.e., to turn from right to left). The head wobbles or "bobbles" in response to movements that are incurred by the head or by the body. The spring transfers energy (kinetic) between the body and the head so as to impart a range of motion to the head relative to the body that appears to bring a level of animation to the head. This increases both the realism and novelty of the figurine.

Figurines that include a bobble head are well known devices. They are sold for use both as toys and as novelty items. They are sometime even given away for free as a promotional item. For example, it is not uncommon to see a bobble head figurine that resembles that of a popular character commonly associated with a fast food restaurant atop a dashboard of an automobile. The bobbling of the head amuses the driver and the caricature itself reminds others of the particular restaurant, thereby serving an advertising function for the restaurant.

However, the utility of the bobble head figurine is limited. It is desirable to be able to hold a fluid for consumption in a container that includes a bobble head. This would help in marketing (advertising) as was mentioned above while making utilitarian use of the figurine.

Accordingly, there exists today a need for a bobble head fluid container that is adapted to hold a fluid.

Clearly, such an apparatus would be a useful and desirable device.

2. Description of Prior Art

Bobble head devices as well as drinking containers are, in general, known but not together. For example, the following patents describe various types of these devices:

U.S. Pat. No. 2,893,591 to Barradas, Jul. 7, 1959;
U.S. Pat. No. 4,815,999 to Ayon et al., Mar. 28, 1989;
U.S. Pat. No. 4,816,000 to Hsu, Mar. 28, 1989;
U.S. Pat. No. 4,923,084 to Forbes, May 8, 1990;
U.S. Pat. No. 5,162,013 to von Mohr, Nov. 10, 1992;
U.S. Pat. No. 5,277,646 to Fekete et al., Jan. 11, 1994;
U.S. Pat. No. 5,636,740 to Finkiewicz et al., Jun. 10, 1997;
U.S. Pat. No. 6,382,440 to Brant et al, May 7, 2002;
U.S. Pat. No. 6,505,734 to Su, Jan. 14, 2003;
U.S. Pat. No. 6,511,359 to Lui, Jan. 28, 2003; and
U.S. Design Patent No. 282,339 to Wei, Jan. 28, 1986.

Also, U.S. Pat. No. 6,494,056 to Roth, et al, that issued Dec. 17, 2002, appertains to a thermal energy storing device that was used on an apparatus manufactured or marketed by Cool Gear International, Inc. Duxbury, Mass. 09332, telephone 1 800 386-3374 and covered by U.S. Design Patent 472,563 for a refreezable beverage cooler. This apparatus includes a container with a conduit extending through a head. The head is supported by a spring and can be urged up or down longitudinally but the conduit prevents it from bobbling (i.e., having a full range of side to side tilting) as is characteristic of a true bobble head. It is also not possible to acquire any fluid from the container without having to tilt the container upside down. This causes the head to move longitudinally and strike the mouth of the person using the device, clearly an undesirable condition.

While the structural arrangements of the above described devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a bobble head fluid container that is adapted to contain a fluid and which has a bobble head attached thereto.

It is also an important object of the invention to provide a bobble head fluid container that is economical to manufacture and which is adapted to contain a fluid and which has a bobble head attached thereto and which is adapted to receive a straw that can contact the fluid.

Still another object of the invention is to provide a bobble head fluid container that is adapted to contain a fluid and which has a bobble head attached thereto and which is adapted to receive a straw that that does not pass through the bobble head and which can contact the fluid.

Still yet another object of the invention is to provide a bobble head fluid container that is adapted to contain a fluid and which has a bobble head attached thereto and which can be refilled with an additional fluid.

Yet another important object of the invention is to provide a bobble head fluid container that is adapted to contain a fluid and which has a bobble head attached thereto and which is adapted to receive a straw that passes through the container at a location that is disposed below the bobble head and wherein the straw is adapted to make contact with the fluid and wherein an additional fluid can be added to the container.

A first further important object of the invention is to provide a bobble head fluid container that is adapted to contain a fluid and which has a bobble head attached thereto and which includes a top that can be opened to add or drain the fluid from the container.

A second further important object of the invention is to provide a bobble head fluid container that is adapted to contain a fluid and which has a bobble head attached thereto and which includes a top that can be opened to add or drain the fluid from the container and which is adapted to receive a straw.

A third further important object of the invention is to provide a bobble head fluid container that is adapted to contain a fluid and which has a bobble head attached thereto and wherein the container is able to be separated into an upper and a lower portion sufficient to add or drain fluid from the lower portion of the container.

A fourth further important object of the invention is to provide a bobble head fluid container that is adapted to contain a fluid and which has a bobble head attached thereto and wherein the container is able to be separated into an upper and a lower portion sufficient to add or drain fluid from the lower portion of the container. and which is adapted to receive a straw.

A fifth further important object of the invention is to provide a bobble head fluid container that is adapted to support a bobble head on a threaded lid that is hidden from view.

A sixth further important object of the invention is to provide a bobble head fluid container that is adapted to provide a container that includes a hole that is adapted to receive a straw and contact a fluid in the container and which includes a bobble head that is disposed above a threaded cap, and wherein the bobble head is adapted to be urged downward to engage with the cap sufficient to permit loosening or tightening of cap according to the direction the bobble head is rotated.

A seventh further important object of the invention is to provide a bobble head fluid container that allows consumption of a fluid disposed in the container without having to dispose the container in an attitude other than normal (i.e., flat).

An eight further important object of the invention is to provide a bobble head fluid container that includes a straw (conduit) that contacts a fluid disposed in the container when the container in disposed a normal flat and level position.

A ninth further important object of the invention is to provide a bobble head fluid container that includes a straw (conduit) that includes a lower end that is placed within a fluid disposed in the container when the container in disposed a normal flat and level position and which allows consumption of the fluid when a partial vacuum is created at an upper end of straw sufficient to draw the fluid up through the straw and into a mouth of a user.

Briefly, a bobble head fluid container that is constructed in accordance with the principles of the present invention has a container and a bobble head affixed to a top of the container. The container is adapted to contain a fluid for consumption by a human. A hole to insert a straw is provided through a side of the container. The container includes a lid or, according to a modification, is separable into two halves, an upper half and a lower half. When the lid is used, the bobble head is disposed above the lid. When the container is separable the upper half serves as a lid and the lower half serves as the container for the fluid. According to a preferred modification, the lid can be unscrewed and removed apart from the container if the bobble head is depressed sufficient to engage a plurality of teeth on the bobble head with a plurality of recesses on the lid.

DETAILED DESCRIPTION OF THE INVENTION

Figure 1:
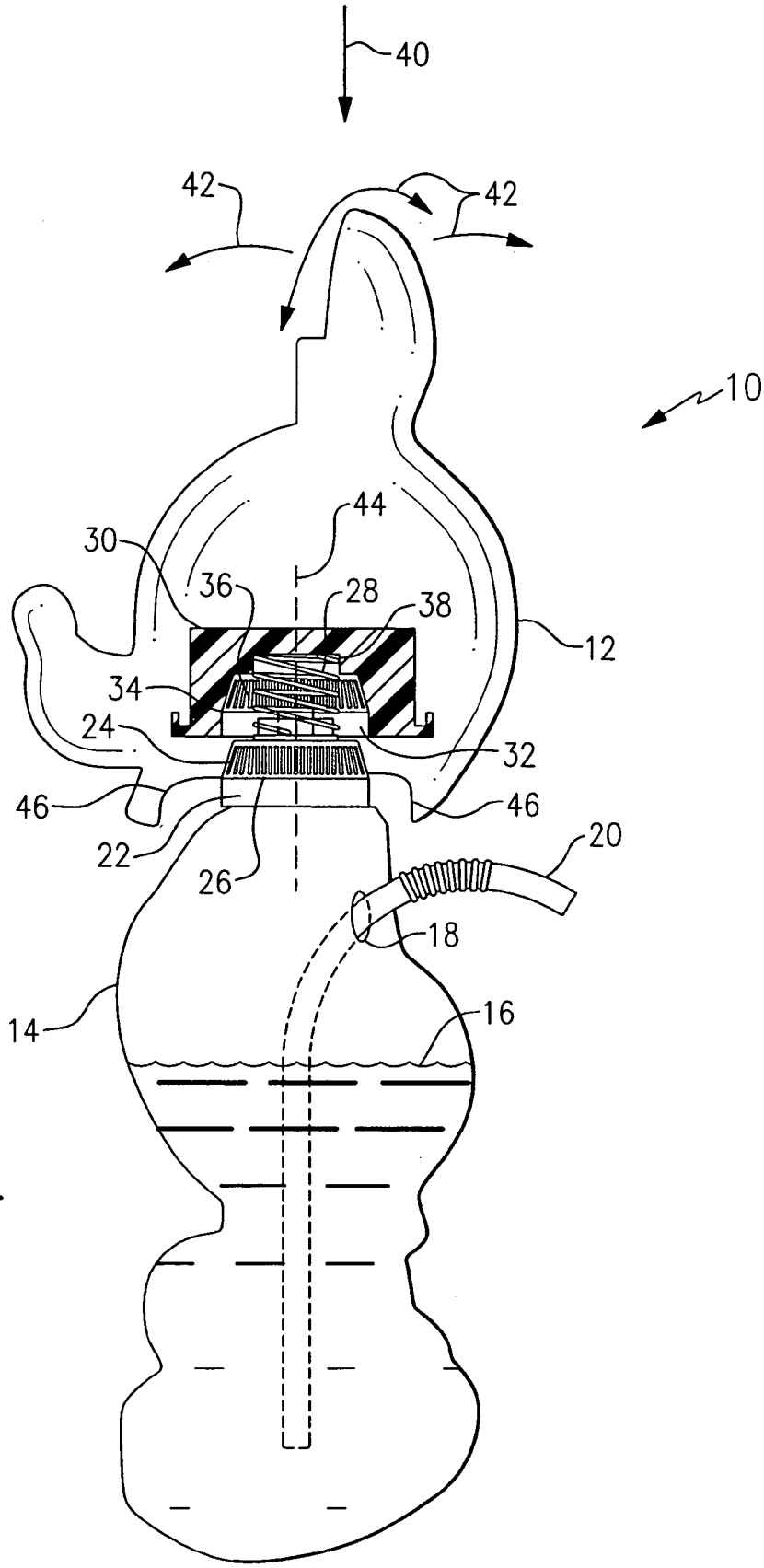
FIG. 1 is a side view of bobble head fluid container, shown partially in cross-section.

Referring to FIG. 1 is shown, a bobble head fluid container, identified in general by the reference numeral 10.

The bobble head fluid container 10 includes a bobble head 12 and a fluid container 14. The example shown resembles a caricature of a well known cartoon mouse, although any appearance can be used. For example, the bobble head fluid container 10 may resemble a man, woman, child, infant, baby, animal, comic or cartoon character, movie character, monster, mythological creature, etc.

Regardless of the appearance, the bobble head fluid container 10 will always include the bobble head 12 (in some form) and the fluid container 14 (in some form). The shape and size of the bobble head 12 and of the fluid container 14 will vary, as desired.

The bobble head 12 and the fluid container 14 of the bobble head fluid container 10 combine to produce an overall appearance of a figurine. The fluid container 14 is hollow and is adapted to contain a fluid 16 for human consumption. The fluid 16 is any preferred fluid in a liquid state, for example, milk, chocolate milk, soda, etc. While it is possible to use the bobble head fluid container 10 with a hot beverage, it is intended primarily for use when the fluid 16 is at or below room temperature (i.e., cooled).

The fluid container 14 includes a hole 18 that is adapted to receive a straw 20. The straw 20 is inserted through the hole 18 sufficient so that a lower end of the straw 20 makes contact with the fluid 16. An upper end of the straw 20 is used to draw (i.e., to suck) the fluid 16 out of the fluid container 14 by creating a partial vacuum at the upper end of the straw 20.

A lid 22 is provided that includes interior threads that are adapted to cooperate with corresponding outer threads on top of the fluid container 14. This method of attachment is in general well known and is commonly referred to as a "screw-type of lid".

The lid 22 is provided for access to the interior of the fluid container 14 (i.e., to access an upper opening) and is used to fill the fluid container 14 with the fluid 16. The lid 22 can also be loosened to drain any remaining quantity of the fluid 16 from the fluid container 14.

The lid 22 is unscrewed to either fill or drain the fluid container 14. This is described in greater detail hereinafter.

The lid 22 is circular and includes a tapered side 24. The tapered side 24 leads to a top of the lid 22 that includes a smaller diameter than a lower portion of the lid 22 that attaches to the fluid container 14.

Disposed around an outer circumference of the tapered side 24 are a plurality of alternating raised parallel ridges and depressions 26 (i.e., longitudinal protrusions and recesses) that each include a substantially vertical longitudinal axis thereof and which are disposed at an angle away from vertical that corresponds to the angle of the tapered side 24.

A lower end of a spring 28 is attached to the top of the lid 22. The lower end of the spring 28 is molded into the top of the lid 22 or otherwise secured.

A support member 30 (shown in cross-section) is structurally attached to the bobble head 12 and is capable of supporting the weight of the bobble head 12. The support member 30 may be molded into the bobble head 12 as an integral part thereof or it may be a separate component that is attached to the bobble head 12.

The support member 30 includes a recess 32. The recess 32 includes interior tapered sides 34 that match the tapered side 24 of the lid 22. The recess 32 is open at a bottom and is closed at a top. Accordingly, a cross-sectional view of the recess 32 includes a shape that approximates a frustum (i.e., a section) of a cone.

An interior circumference of the tapered sides 34 include a plurality of alternating raised parallel ridges and depressions 36 (i.e., longitudinal protrusions and recesses) that are adapted to cooperate with the plurality of alternating raised parallel ridges and depressions 26 of the lid 22.

An upper end of the spring 28 is secured to the support member 30 by inserting it into a recess 38 that is provided in the support member 30.

The upper end of the spring 28 is retained by a friction fit with the recess 38 or it can be molded or attached in other ways, as described hereinafter for both the upper and lower ends thereof.

The spring 28 is sufficiently strong to retain the bobble head 12 in cooperation with the lid 22 and to support the bobble head 12 a small distance above the lid 22 whenever the bobble head 12 is not being urged otherwise by another force (i.e., by the hand of a user-not shown).

To open the lid 22 and gain access to the interior of the fluid container 14 for filling or draining of the fluid 16, a force is applied by a user in a downward direction as shown by arrow 40. The force must be of sufficient magnitude to compress the spring 28 and urge the bobble head 12 down toward the lid 22.

As the bobble head 12 is urged downward, the plurality of alternating raised parallel ridges and depressions 36 on the interior tapered sides 34 of the support member 30 cooperate and engage with the plurality of alternating raised parallel ridges and depressions 26 of the lid 22, much like the teeth on a pair of gears (not shown) mesh together when brought together (A small rotary movement of the bobble head 12 may be required for proper engagement).

While maintaining downward pressure on the bobble head 12, the bobble head 12 is then rotated in a counter-clockwise direction (looking down on the top of the fluid container 14) to unscrew, loosen, and remove the lid 22 apart from the fluid container 14.

The lid 22, spring 28, support member 30, and bobble head 12 are then removed apart from the fluid container 14 as an integral assembly.

The lid 22 covers the top opening into the fluid container 14. The opening can be used to add a quantity of the fluid 16 to an inside of the fluid container 14, refill the fluid container 14 with more of the fluid 16 (or a different type of fluid), or drain the remaining quantity of the fluid 16 from the fluid container 16.

If the fluid 16 has been removed for cleaning purposes, the straw 20 is also removed and the fluid container 16 and the detached assembly containing the lid 22, spring 28, support member 30, and bobble head 12 are either manually washed or are placed in a dishwasher for cleaning and subsequent reuse. Depending upon the quality of the straw 20 it may be discarded if it is of inferior quality or it too can be washed if it is of superior quality and is to be reused.

When the fluid container 16 is either initially filled or refilled with the fluid, the assembly (i.e., the lid 22, spring 28, support member 30, and bobble head 12) is placed atop the fluid container 14. The bobble head 12 is once again urged in the direction of the arrow 40 and is then rotated in a clockwise direction an amount sufficient to tighten the lid 22. Once the lid 22 is deemed to be sufficiently tight as is indicated by a sudden increase in resistance to its continued turning, the force along arrow 40 is removed. Once the force is removed, the spring 28 urges the bobble head 12 away from the lid 22.

In this elevated position, the bobble head 12 can bobble with respect to the lid 22 (and the fluid container 14) as shown by second arrows 42. The space intermediate the interior tapered sides 34 of the support member 30 and the spring limit the range of motion. The head 12 can bobble (i.e., tilt from side to side) in any direction along 360 degrees of arc rotation about a center longitudinal axis 44 of the spring 28. If the head 12 is twisted, it can also rotate a small amount as permitted by the spring 28 around the center longitudinal axis 44, which equates to a turning of the head 12 from right to left (side to side).

To provide clearance for the bobble head 12 to tilt from side to side (i.e., to bobble), the bottom of the bobble head 12 is provided with a large opening 46 that includes sufficient clearance intermediate the bottom of the bobble head 12 and the outside of the fluid container 14.

Figure 2:
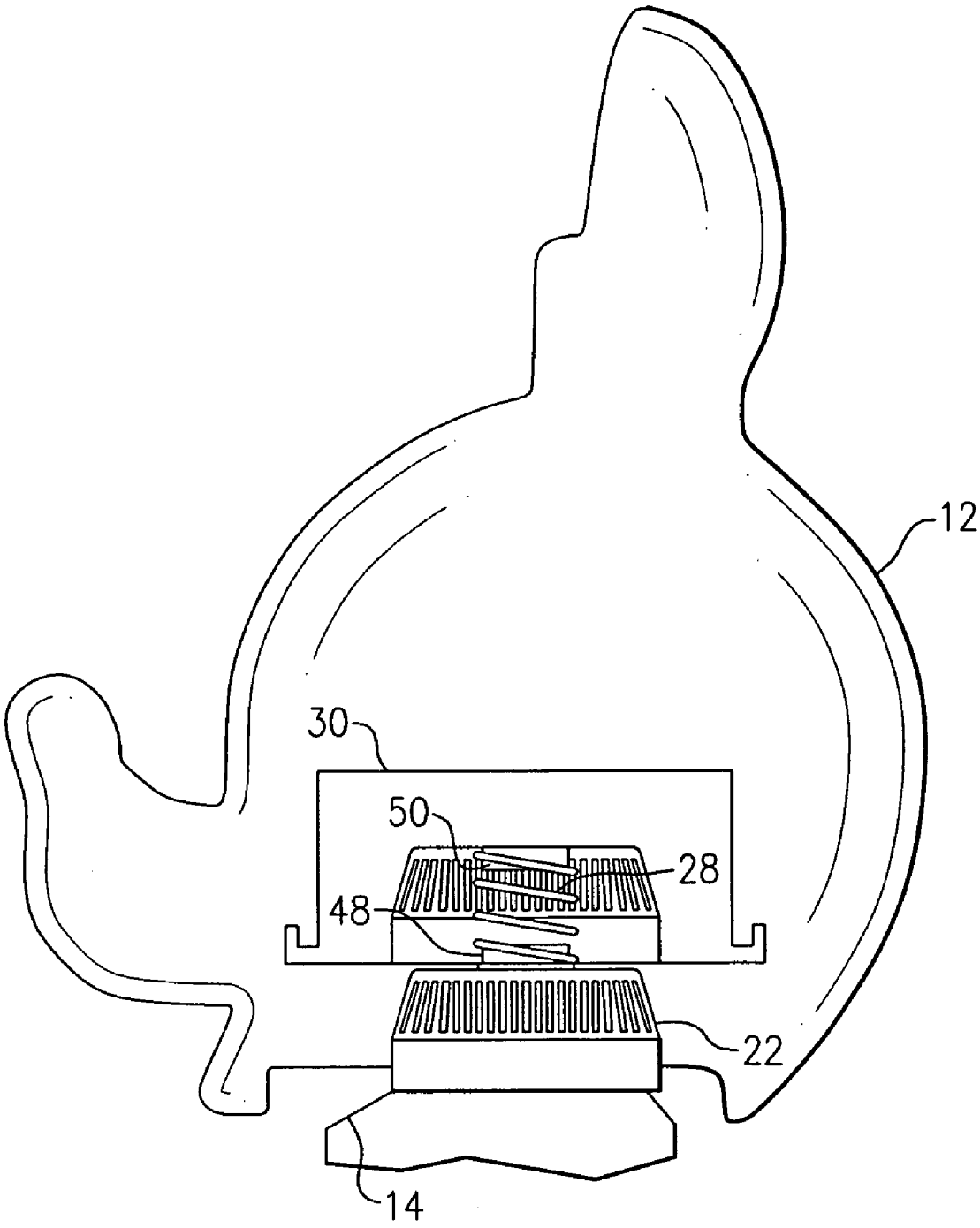
FIG. 2 is a side view of an alternate method of attaching a spring to a lid of the device of FIG. 1.

Referring momentarily to FIG. 2, an alternative method of attaching the lower end of the spring 28 to the top of the lid 22 and to the bobble head 12 is shown and it includes providing a first cylindrical extension 48 that is molded on top of the lid 22 and a second cylindrical extension 50 that is molded inside the bobble head 12 to the support member 30.

Each end of the spring 28 includes a diameter that is preferably slightly less than that of either cylindrical extensions 48, 50. Each end of the spring 28 is forced over each extension 48, 50. The spring 28 ends expand slightly and apply a force to each extension 48, 50 sufficient to retain each end of the spring 28 in position by a friction fit.

Figure 3:
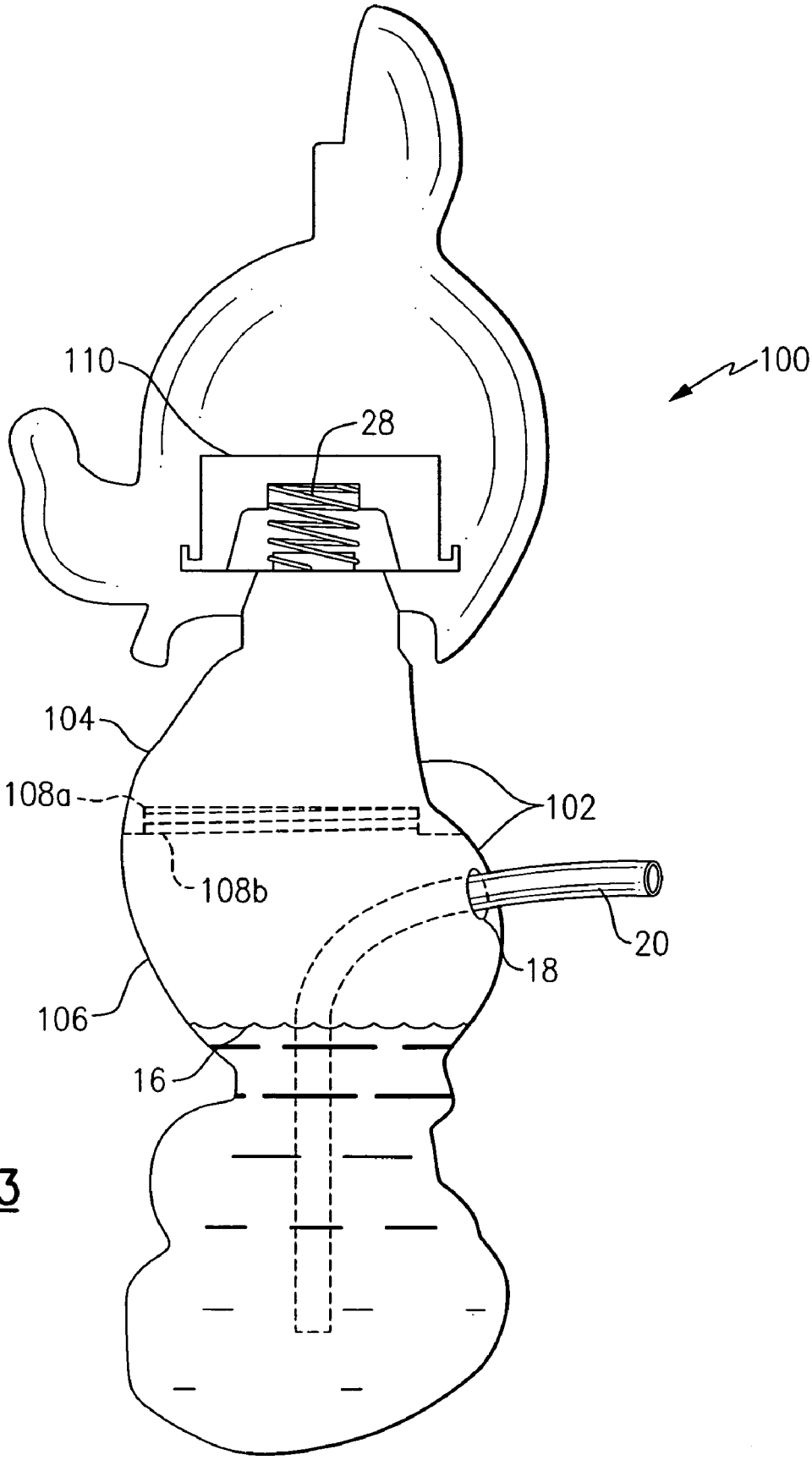
FIG. 3 is a side view of a modified bobble head fluid container, shown partially in cross-section.

Referring now to FIG. 3 is shown a side view of a modified bobble head fluid container 100.

A modified fluid container 102 includes an upper half 104 and a lower half 106. The upper half 104 includes interior threads 108*a* that match with exterior threads 108*b* of the lower half 106.

The hole 18 is provided through the lower half 106 of the modified fluid container 102. The straw 20 passes through the hole 18 and makes contact with the fluid 16 that is disposed only in the lower half 106.

The upper half 104 is unscrewed from the lower half 106 to fill or drain the lower half 106. An opening is provided at the top of the lower half 106 proximate (i.e., inside) the exterior threads 108*b* of the lower half 106.

The upper half 104 is sealed above the interior threads 108*a* and thereby provides a seal that contains all of the fluid 16 in the lower half 106.

The spring 28 is attached at the top to a modified support member 110. The spring 28 is attached at the bottom to an upper portion of the upper half 104.

The modified support member 110 does not need to include any protrusions (ridges) or recesses. To remove the upper half 104, the upper half 104 itself is grasped and is rotated counterclockwise with respect to the lower half 106 until it is free and separate. To tighten, the process is reversed.

The advantage to the modified bobble head fluid container 100 is that its bobble head portion is somewhat more simple in construction than that of the bobble head fluid container 10. The disadvantage is that the lower half 106 tends to provide a smaller capacity for the fluid 16. Also, the lid 22 is hidden when it is disposed under the bobble head 12, and this adds to the realism of the figurine.

Clearly, many modifications are possible. For example, wherever screw threads are used, a snap type of a modified lid or engagement can be used.

For either modification 10, 100, the straw 20 includes a lower end that is placed in the fluid 16. When the fluid container 14 (or the lower half 106 of the modified fluid container 102) includes the fluid 16, a partial vacuum created by sucking on the opposite upper end of the straw 20 draws the fluid 16 up through the straw 20 and into the mouth of the user.

It is important to note that the fluid container 14 and the modified fluid container 102 remain in a level attitude with respect to a ground surface while the fluid 16 is being drawn up through the straw 20 for consumption.

This provides a significant benefit in that the bobble head 12 (or bobble head portion of the modified fluid container 102) cannot strike the mouth of the user. This makes the apparatus safer to use and more friendly because it cannot cause a sudden jolt to the user.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An improved container for holding a fluid for human consumption, wherein the improvement comprises:

(a) a bobble head attached to said container, said bobble head including a shape that replicates at least some feature of a head and wherein said bobble head is adapted to tilt in any direction along a three hundred and sixty degree arc around a longitudinal vertical axis passing through said bobble head; and (b) a hole in said container passing through a wall of said container for inserting a straw therein wherein said hole is disposed below said bobble head and wherein said straw does not pass through said bobble head.

2. An improved container for holding a fluid for human consumption, wherein the improvement comprises:

(a) a bobble head attached to said container, said bobble head including a shape that replicates at least some feature of a head and wherein said bobble head is adapted to tilt in any direction along a three hundred and sixty degree arc around a longitudinal vertical axis passing through said bobble head;

(b) a hole in said container passing through a wall of said container for inserting a straw therein wherein said hole is disposed below said bobble head and wherein said straw does not pass through said bobble head; and (c) an opening in said container that is larger than said hole, said opening adapted for filling said container with said fluid.

3. A bobble head fluid container, comprising:

(a) a container for holding a quantity of a fluid therein having a hollow interior and an opening for filling said container;

(b) a spring including a lower end thereof that is secured to an upper end of said container;

(c) a replica of at least some aspect of a head secured to an upper end of said spring;

(d) a hole in said container for receiving a straw, said hole being disposed through a wall of said container at an elevation that is below said replica of a head; and (e) means for detachably sealing said opening sufficient to prevent said fluid from passing through said opening when said means for detachably sealing is engaged and wherein when said means for detachably sealing is not engaged, said fluid is able to pass through said opening.

4. The bobble head fluid container of claim 3 including a lid, wherein said lower end of said spring is secured to said lid.

5. The bobble head fluid container of claim 4 wherein said lid is detachably-attachable to said container and wherein said lid includes said means for detachably sealing said opening.

6. The bobble head fluid container of claim 5 wherein said lid includes screw threads and wherein said container includes corresponding screw threads disposed around said opening, and wherein said corresponding screw threads are adapted for mating with said screw threads of said lid.

7. The bobble head fluid container of claim 4 including a support member disposed in said bobble head, said support member secured to an upper end of said spring.

8. The bobble head fluid container of claim 7 wherein said lid includes tapered sides wherein a top of said lid includes a smaller diameter than a bottom of said lid and wherein said tapered sides include a plurality of first longitudinal alternating protrusions and recesses disposed around an outer circumference of said lid and wherein said support member includes a recess that includes interior tapered sides and wherein said recess includes a shape substantially that of a frustum of a cone and wherein said interior tapered sides include a plurality of second longitudinal alternating protrusions and recesses disposed around an inner circumference of said recess wherein said plurality of first longitudinal alternating protrusions and recesses are adapted to engage with said plurality of second longitudinal alternating protrusions and recesses when a force is applied to said bobble head to urge said bobble head down toward said lid sufficient to compress said spring and to allow said alternating first and second protrusions and recesses to mesh together.

9. The bobble head fluid container of claim 8 wherein when said plurality of first longitudinal alternating protrusions and recesses engage with said plurality of second longitudinal alternating protrusions and recesses, as said bobble head is rotated in either a clockwise or counterclockwise direction about a vertical center longitudinal axis, said lid is adapted to tighten on said container or loosen, respectively.

10. The bobble head fluid container of claim 9 wherein when said bobble head is rotated sufficiently far in a counterclockwise direction, said lid is disengaged from a position of cooperation with said container and wherein said bobble head, said support member, said spring, and said lid together form an assembly that can be removed from said container sufficiently far to provide access to said opening in said container.

11. The bobble head fluid container of claim 3 wherein said container includes a lower half and an upper half, and wherein said opening is disposed in said lower half and wherein said hole is disposed in said lower half and including means for detachably-attaching said upper half to said lower half, and wherein said upper half includes a seal to prevent said fluid from escaping from any part of said upper half when said upper half and said lower half are attached to each other.

12. The bobble head fluid container of claim 11 wherein said means for detachably-attaching includes a first set of screw threads attached proximate a bottom of said upper half and a second set of corresponding screw threads attached to said lower half and wherein said second set of corresponding screw threads is disposed around said opening.

13. The bobble head fluid container of claim 3 wherein said container includes an opening and said opening includes means for sealing said opening and wherein said bobble head includes means for engaging with said means for sealing sufficient to remove said means for sealing from said container.

14. The bobble head fluid container of claim 13 wherein said means for sealing includes a lid having screw threads that are adapted to mate with corresponding screw threads that are disposed proximate said opening on said container and wherein said means for engaging includes providing a shape in a portion of said bobble head that is adapted to interlock with a corresponding shape that is provided in said lid and wherein said portion of said bobble head is adapted to be urged to engage with said corresponding shape in said lid sufficient to cause said lid to rotate when said bobble head is rotated.

15. The bobble head fluid container of claim 14 including a spring intermediate said bobble head and said lid.

16. An improved container for holding a fluid for human consumption, wherein the improvement comprises:

(a) a bobble head attached to said container, said bobble head including a shape that replicates at least some feature of a head and wherein said bobble head is adapted to tilt in any direction along a three hundred and sixty degree arc around a longitudinal vertical axis passing through said bobble head; and (b) a hole in said container passing through a wall of said container for inserting a straw therein wherein a fluid disposed in said container is adapted for withdrawal through said straw when said container is disposed in a level attitude with a bottom surface thereof is substantially level.

17. A method for making a bobble head fluid container, comprising the steps of:

(a) providing a container for holding a quantity of a fluid therein having a hollow interior and an opening for filling said container;

(b) providing a spring including a lower end thereof and securing said lower end of said spring to an upper end of said container;

(c) providing a replica of at least some aspect of a head and securing said replica of a head to an upper end of said spring;

(d) providing a hole in said container for receiving a straw, said hole being disposed through a wall of said container at an elevation that is below said replica of a head; and (e) including means for detachably sealing said opening sufficient to prevent said fluid from passing through said opening when said means for detachably sealing is engaged and wherein when said means for detachably sealing is not engaged said fluid is able to pass through said opening.

* * * * *